US010982366B2

(12) United States Patent
Nomatsu et al.

(10) Patent No.: US 10,982,366 B2
(45) Date of Patent: Apr. 20, 2021

(54) SEWING MACHINE

(71) Applicant: JUKI CORPORATION, Tama (JP)

(72) Inventors: Masatoshi Nomatsu, Tama (JP); Daisuke Kato, Tama (JP); Toshiyuki Takeda, Tama (JP)

(73) Assignee: JUKI CORPORATION, Tama (JP)

( * ) Notice: Subject to any disclaimer, the term of this patent is extended or adjusted under 35 U.S.C. 154(b) by 122 days.

(21) Appl. No.: 16/449,803

(22) Filed: Jun. 24, 2019

(65) Prior Publication Data

US 2019/0390384 A1 Dec. 26, 2019

(30) Foreign Application Priority Data

Jun. 25, 2018 (JP) ..... JP2018-119450

(51) Int. Cl.
*D05B 65/02* (2006.01)
*D05B 65/06* (2006.01)

(52) U.S. Cl.
CPC ..... *D05B 65/02* (2013.01); *D05B 65/06* (2013.01)

(58) Field of Classification Search
CPC ..... D05B 65/06; D05B 65/02
See application file for complete search history.

(56) References Cited

U.S. PATENT DOCUMENTS 4,370,940 A * 2/1983 Melzer ..... D05B 65/00 112/286
4,672,902 A * 6/1987 Michaels ..... D05B 65/06 112/287
5,065,683 A * 11/1991 Hayashi ..... D05B 65/02 112/292
5,303,664 A * 4/1994 Imai ..... D05B 65/00 112/292
8,025,017 B2 * 9/2011 Niizeki ..... D05B 65/00 112/291
8,302,547 B2 * 11/2012 Tseng ..... D05B 65/02 112/291
2010/0175602 A1 * 7/2010 Tseng ..... D05B 65/02 112/292

FOREIGN PATENT DOCUMENTS

JP 2007-29437 A 2/2007

* cited by examiner

*Primary Examiner* — Tajash D Patel

(74) *Attorney, Agent, or Firm* — Faegre Drinker Biddle & Reath LLP

(57) ABSTRACT

A sewing machine includes a controller and a thread cutter which cuts an upper thread passed through a sewing needle and which has a fixed knife, a moving knife, and a driving source to drive the moving knife. The moving knife cuts the upper thread by guiding the upper thread. The moving knife has a through-hole into which the sewing needle is loosely insertable and includes a thread cutting portion in an inner edge portion of the through-hole. By controlling the driving source, the controller makes a stitch point of a first stitch of the sewing needle with respect to the through-hole of the moving knife, and moves the moving knife to a position where the fixed knife and the moving knife cut a sewing start end portion of the upper thread after a stitch point of a second stitch of the sewing needle.

6 Claims, 12 Drawing Sheets

SEWING MACHINE

CROSS-REFERENCE TO RELATED APPLICATIONS

This application is based upon and claims the benefit of priority from Japanese Patent Application No. 2018-119450, filed on Jun. 25, 2018; the entire contents of which are incorporated herein by reference.

TECHNICAL FIELD

The present invention relates to a sewing machine that processes a sewing start end portion of an upper thread.

BACKGROUND ART

A sewing machine of the related art includes a needle vertical movement mechanism that vertically moves a sewing needle; a shuttle mechanism that captures an upper thread that has passed through the sewing needle; and a thread cutter that cuts the upper thread and a lower thread at a sewing end, in which seams are formed and sewing is performed by both of the needle vertical movement mechanism and the shuttle mechanism (for example, refer to JP-A-2007-029437).

SUMMARY OF INVENTION

In the sewing machine of the related art, at the first stitch of sewing, the sewing start end portion of the upper thread that has passed through an eye of the sewing needle is drawn to a lower side of cloth by the shuttle mechanism. When the sewing start end portion of the upper thread is drawn to the lower side of the cloth, the sewing start end portion may be caught by the seam after the second stitch in some cases. Accordingly, a so-called thread-entangled state called a bird's nest occurs, which causes a problem of deterioration in sewing quality.

An object of the invention is to improve the sewing quality.

(1) A sewing machine includes a needle vertical movement mechanism and a thread cutter. The needle vertical movement mechanism applies vertical movement to a sewing needle. The thread cutter cuts an upper thread passed through the sewing needle, on a lower side of a throat plate. The thread cutter includes a fixed knife, a moving knife and a driving source. The moving knife cuts the upper thread by guiding the upper thread close to a thread cutting portion of the fixed knife. The driving source drives the moving knife to guide the upper thread. The moving knife has a through-hole into which the sewing needle is loosely insertable and includes a thread cutting portion in an inner edge portion of the through-hole. The sewing machine further includes a controller. By controlling the driving source, the controller makes a stitch point of a first stitch of the sewing needle with respect to the through-hole of the moving knife, and moves the moving knife to a position where the fixed knife and the moving knife cut a sewing start end portion of the upper thread after a stitch point of a second stitch of the sewing needle.

In the sewing machine according to (1), by the driving source, the controller maintains a state where the sewing start end portion of the upper thread is pinched by moving the moving knife to a pinch position without cutting the sewing start end portion of the upper thread by the fixed knife and the moving knife after the stitch point of the first stitch of the sewing needle.

(3) In the sewing machine according to (1) or (2), the moving knife includes a sorting portion and a thread handling portion. The sorting portion is provided in an end portion on a downstream side in a direction which is opposite to a thread cutting operation with respect to the fixed knife and sorts the upper thread. The thread handling portion is provided in an end portion on a downstream side in a direction of the thread cutting operation with respect to the fixed knife and handles the upper thread. The through-hole is provided between the sorting portion and the thread handling portion.

(4) The sewing machine according to any one of (1) to (3), further includes an air blow mechanism. The air blow mechanism blows air to the sewing start end portion of the upper thread.

(5) The sewing machine according to (4), further includes a capturing portion. The capturing portion captures the sewing start end portion of the upper thread blown away by air blowing of the air blow mechanism.

(6) In the sewing machine according to (4) or (5), by controlling the air blow mechanism, the controller starts the air blowing before starting a cutting operation of the sewing start end portion of the upper thread by the moving knife, which is performed after the stitch point of the second stitch of the sewing needle, and the controller ends the air blowing after completing the cutting operation of the sewing start end portion of the upper thread by the moving knife.

In the invention, a moving knife includes a through-hole into which a sewing needle is loosely insertable and which includes a thread cutting portion in an inner edge portion of the through-hole, and a controller controls a driving source and controls the through-hole of the moving knife to make a stitch point of a first stitch of the sewing needle.

Therefore, the sewing start end portion of the upper thread in the through-hole can be excellently held, and the occurrence of bird's nest due to the sewing of the sewing start end portion can be more effectively reduced.

DESCRIPTION OF EMBODIMENTS

Schematic Configuration of Embodiment

Figure 1:
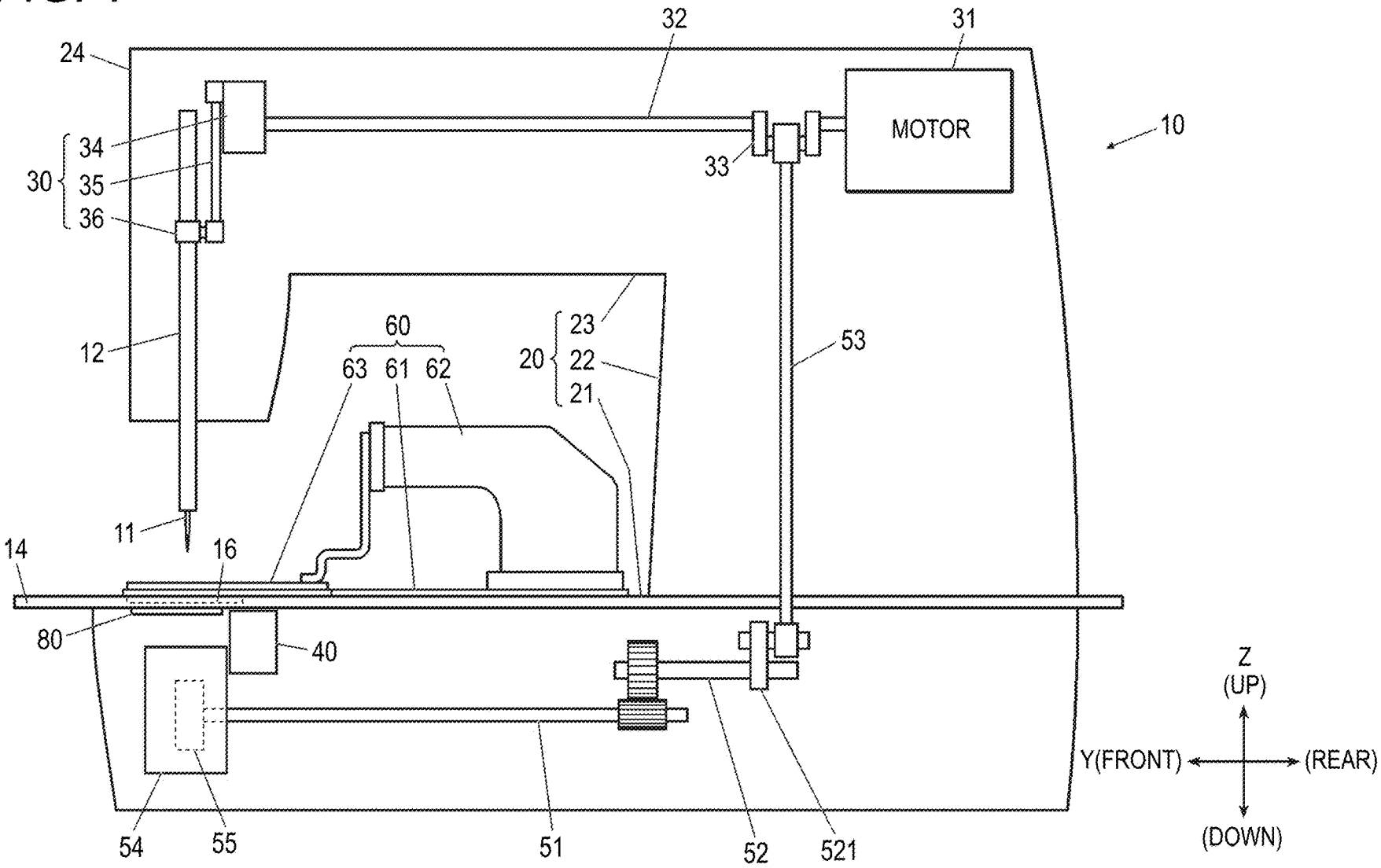
FIG. 1 is a schematic configuration view of a sewing machine according to an embodiment of the invention.
Figure 2:
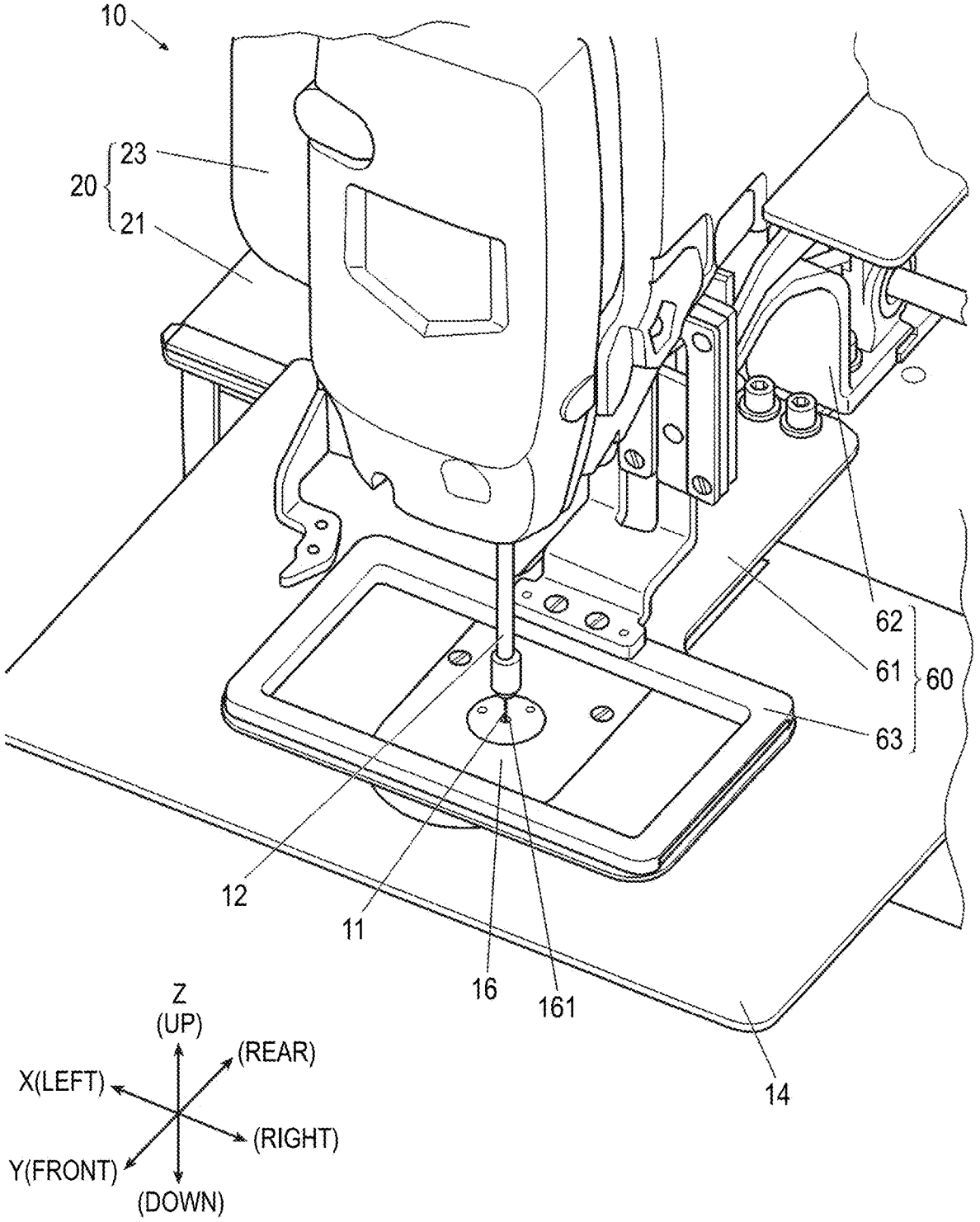
FIG. 2 is a perspective view around a throat plate of the sewing machine.
Figure 3:
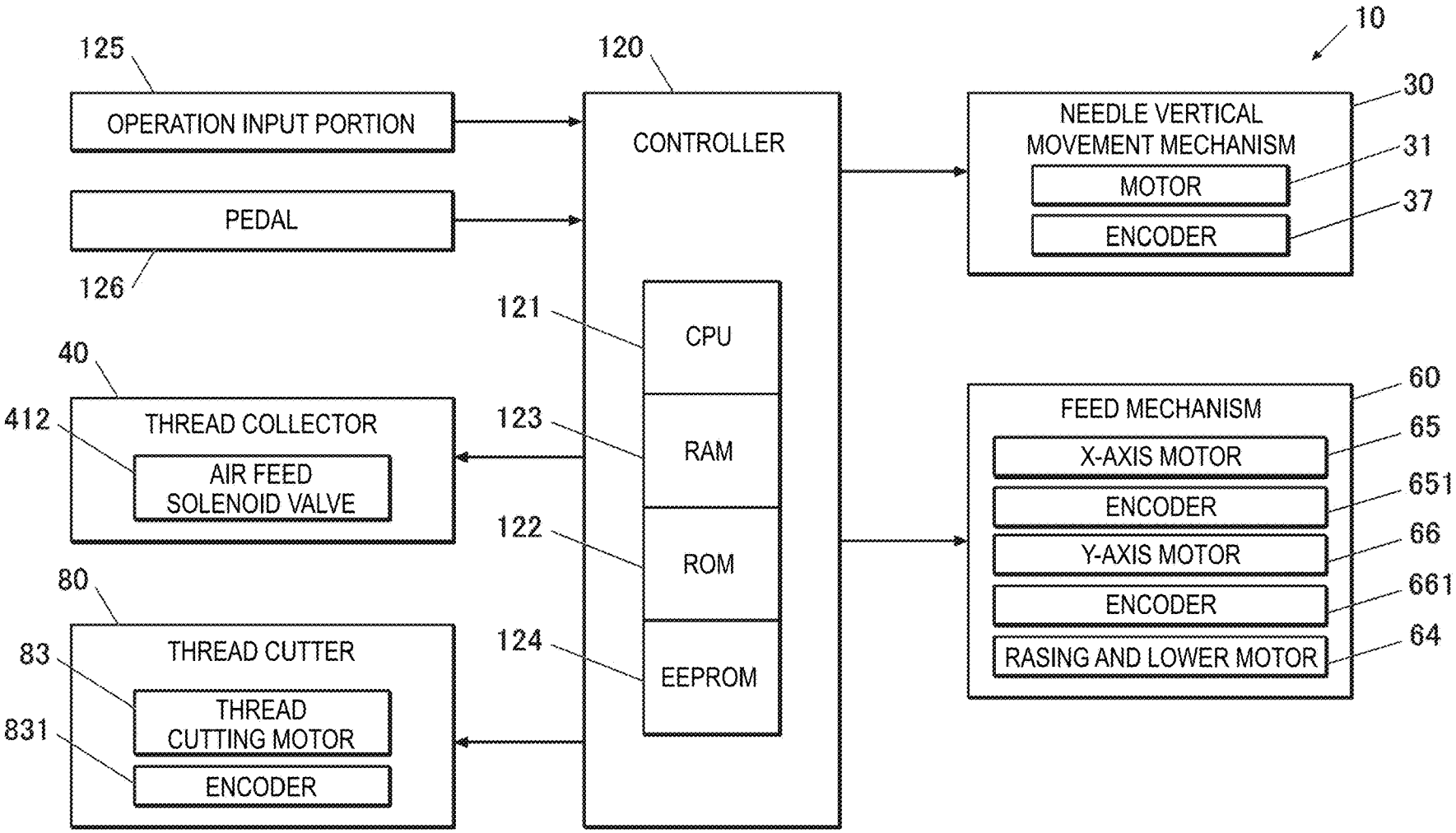
FIG. 3 is a block diagram of a control system of the sewing machine.

Hereinafter, an embodiment of the invention will be described in detail based on FIGS. 1 to 14. FIG. 1 is a schematic configuration view of a sewing machine 10 according to the embodiment, FIG. 2 is a perspective view around a throat plate of the sewing machine 10, and FIG. 3 is a block diagram of a control system.

The sewing machine 10 is a so-called electronic cycle sewing machine which includes a frame 20; a needle vertical movement mechanism 30 that vertically moves a needle bar 12 that holds a sewing needle 11; a throat plate 16 provided at a stitch point position of a bed portion 21 of the frame 20; a shuttle mechanism 50 that entwines an upper thread U of the sewing needle 11 with a lower thread D on a lower side of the throat plate 16; a feed mechanism 60 serving as a moving mechanism that arbitrarily moves a cloth K which is a workpiece along an X-Y plane with respect to the sewing needle 11; a thread cutter 80 that cuts the upper thread U and the lower thread D after the stitch point of a final stitch; a thread collector 40 that collects a sewing start end portion U3 of the upper thread U cut by the thread cutter 80 on the lower side of the throat plate 16; and a controller 120 that performs operation control of each of the configurations.

In addition, since a thread tensioner device, a thread take-up lever, a center presser foot mechanism, and the like are well-known mechanisms mounted in the sewing machine, the illustration and the detailed description thereof will be omitted.

Hereinafter, each of the above-described configurations will be described in order.

[Frame]

As illustrated in FIG. 1, the frame 20 includes the bed portion 21 positioned at a lower part thereof; a upright drum portion 22 that stands upward from one end portion of the bed portion 21; and an arm portion 23 that extends from an upper portion of the upright drum portion 22 along the bed portion 21.

Here, in describing the configuration of the sewing machine 10, a vertical movement direction of the needle bar 12 which will be described later is referred to as a Z-axis direction, a direction which is a direction orthogonal to the Z-axis direction and is parallel to a longitudinal direction of the bed portion 21 and the arm portion 23 is referred to as a Y-axis direction, and a direction orthogonal to both the Z-axis direction and the Y-axis direction is referred to as an X-axis direction.

In addition, when the sewing machine 10 is installed on a horizontal surface, the Z-axis direction is a perpendicular up-down direction, and the X-axis direction and the Y-axis direction are the horizontal directions.

In addition, a side which is one side in the Y-axis direction and is a surface portion 24 side of the frame 20 is referred to as "front", a side reverse thereto is referred to as "rear", a side which is one side in the X-axis direction and is a left hand side in a state of facing the surface portion 24 is referred to as "left", a right-hand side is referred to as "right", one perpendicularly upper side in the Z-axis direction is referred to as "up", and a side reverse thereto is referred to as "down".

At an upper portion of a front end of the bed portion 21, a horizontal workbench 14 is provided, and the throat plate 16 on which a needle hole 161 is formed at the stitch point position is provided to be flush.

Inside the front end portion of the arm portion 23, an upper shaft 32 (main shaft) oriented parallel to the longitudinal direction (Y-axis direction) is rotatably supported.

In addition, inside the bed portion 21, a lower shaft 51 oriented parallel to the longitudinal direction (Y-axis direction) is rotatably supported.

[Needle Vertical Movement Mechanism]

As illustrated in FIG. 1, the needle vertical movement mechanism 30 includes a motor 31 including a servo motor provided in the upper portion of the upright drum portion 22; the upper shaft 32 connected to an output shaft of the motor 31 for rotation; a needle bar crank 34 provided to be fixed to an end portion on a side of a sewing machine surface portion of the upper shaft 32; a crank rod 35 of which one end portion is connected to a position eccentric from the center of rotation by the upper shaft 32 in the needle bar crank 34; and the needle bar 12 connected to the other end portion of the crank rod 35 via a needle bar holder 36.

The needle bar 12 holds the sewing needle 11 at a lower-end portion thereof and is supported by the arm portion 23 so as to be capable of vertically reciprocating along the Z-axis direction.

The motor 31 is a servo motor and includes an encoder 37 (refer to FIG. 3). Then, the controller 120 detects the rotational speed, the upper shaft angle and the like of the motor 31 from the encoder 37 and carries out operation control with respect to the motor 31.

In addition, since the configurations of the needle bar crank 34, the crank rod 35, the needle bar holder 36 and the like are the same as known configurations, the detailed description thereof will be omitted.

[Feed Mechanism]

The feed mechanism 60 moves the cloth K along the upper surface of the horizontal throat plate 16 as illustrated in FIGS. 1 to 3, and arbitrarily moves and positions the cloth K with respect to the sewing needle 11.

Therefore, the feed mechanism 60 includes a lower plate 61 and a base 62 movably supported along the X-axis direction and the Y-axis direction on the upper surface of the bed portion 21; a presser foot 63 that is supported to be capable of being raised and lowered by the base 62 and holds the cloth K from the above of the lower plate 61; a raising and lowering motor 64 that raises and lowers the presser foot 63; an X-axis motor 65 serving as a driving source for moving the presser foot 63 along the X-axis direction via the base 62; and a Y-axis motor 66 serving as a driving source for moving the presser foot 63 along the Y-axis direction via the base 62.

The lower plate 61 is a long flat plate provided along the X-Y plane, the front end portion thereof has a shape of a rectangular case, and the center portion thereof is widely open.

The base 62 stands on the rear end side of the upper surface of the lower plate 61, and the base 62 and the lower plate 61 move along the X-Y plane together with the presser foot 63.

In addition, the presser foot 63 supported by the base 62 is disposed above the front end portion of the lower plate 61. The presser foot 63 is also in a shape of a rectangular case, and is supported to be capable of being raised and lowered along a long hole formed in the front end portion of the base 62. In addition, the lower plate 61 and the presser foot 63 can be superimposed on each other such that opening portions of the lower plate 61 and the presser foot 63 substantially match each other, and sewing is performed inside the opening portions. On the base 62, a raising and lowering lever (not illustrated) of which a tip end portion vertically swings by the raising and lowering motor 64, and the presser foot 63 is engaged with the tip end portion of the raising and lowering lever to apply a raising and lowering operation.

Each of the X-axis motor 65 and the Y-axis motor 66 is a stepping motor of which an operation amount is controlled by the controller 120. The bed portion 21 incorporates a known transmission mechanism for converting the torque of the X-axis motor 65 and Y-axis motor 66 into a linear operation in the X-axis direction and in Y-axis direction, respectively, and the linear operation in the X-axis direction and in the Y-axis direction is transmitted from the X-axis motor 65 and the Y-axis motor 66 to the base 62 and the lower plate 61.

[Shuttle Mechanism]

The shuttle mechanism 50 includes a middle shuttle (not illustrated) that has a half rotary shuttle and reciprocates in synchronization with the vertical movement of the needle bar 12 inside a large shuttle 54; a bobbin and a bobbin case (which are not illustrated) housed inside the middle shuttle; a driver 55 that applies reciprocating rotation to the middle shuttle; a crank rod 53 of which one end portion is connected to a crank portion 33 formed on the upper shaft 32; a reciprocating rotation shaft 52 having an arm portion 521 connected to the other end portion of the crank rod 53; and the lower shaft 51 that accelerates by the reciprocating rotation shaft 52 to perform the reciprocating rotation, and the lower shaft 51 reciprocatively rotates the middle shuttle via the driver 55. In addition, the above-described motor 31 is a driving source of the vertical movement of the needle bar 12 and the rotation operation of the shuttle mechanism 50, the middle shuttle performs the reciprocating rotation in the same cycle as the upper shaft 32, and the upper thread is entwined with the lower thread by the vertical movement of the sewing needle 11 and the rotation of the shuttle mechanism 50. In addition, since the structure and configuration of a half rotary shuttle are known, the detailed description thereof will be omitted.

[Thread Cutter]

Figure 4:
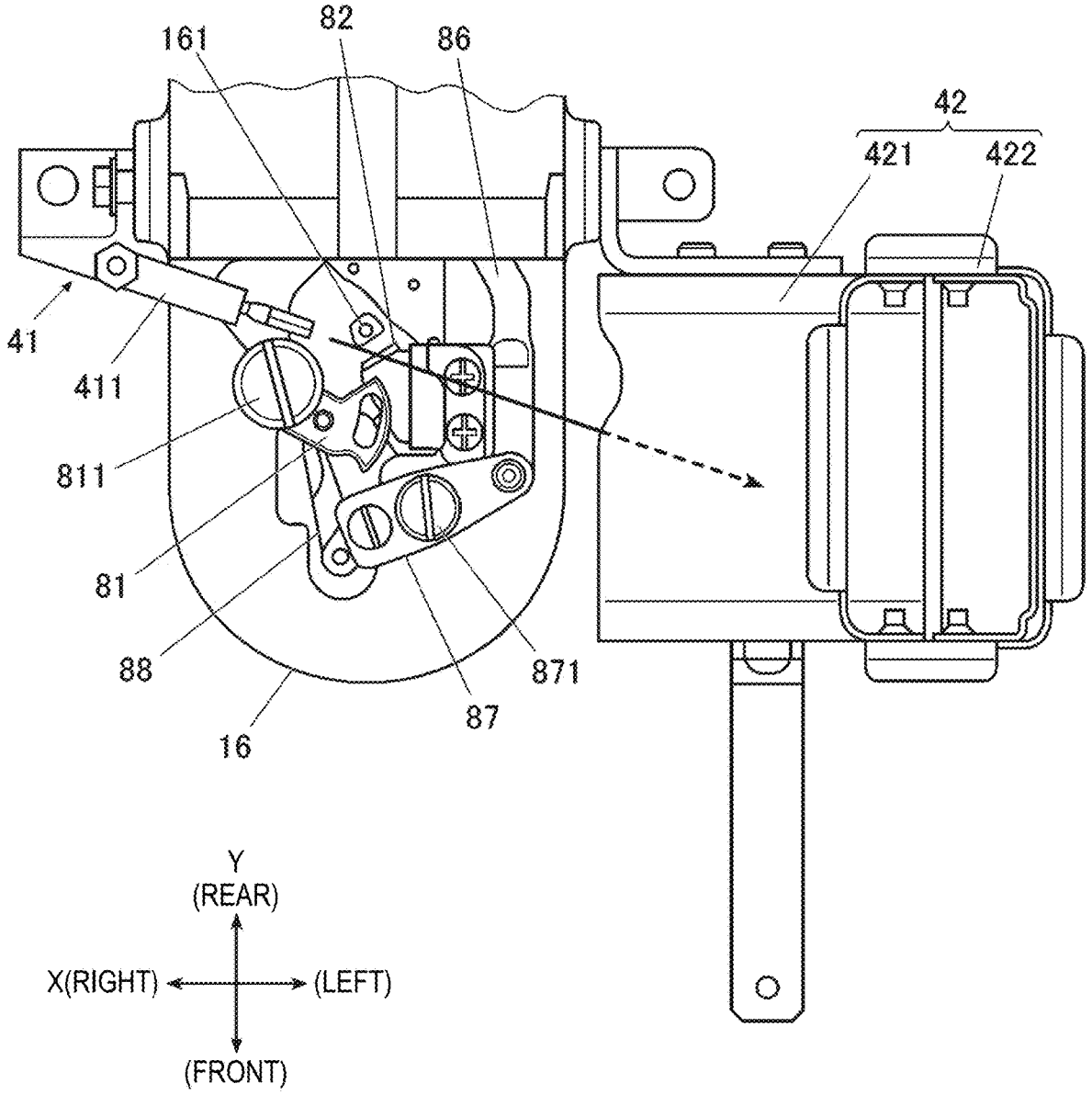
FIG. 4 is a bottom view of a thread cutter and a thread collector.
Figure 5:
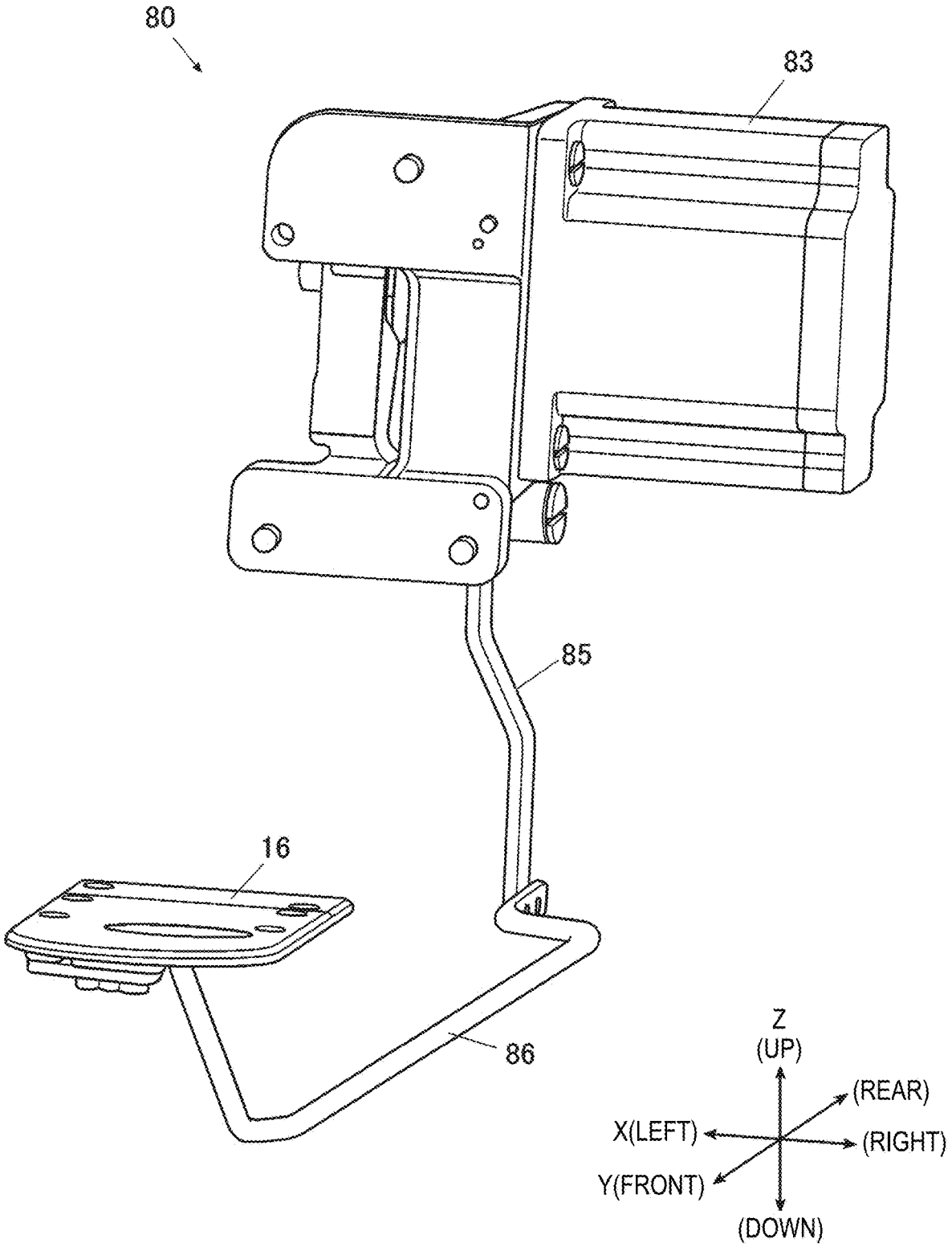
FIG. 5 is a perspective view of the thread cutter.
Figure 6:
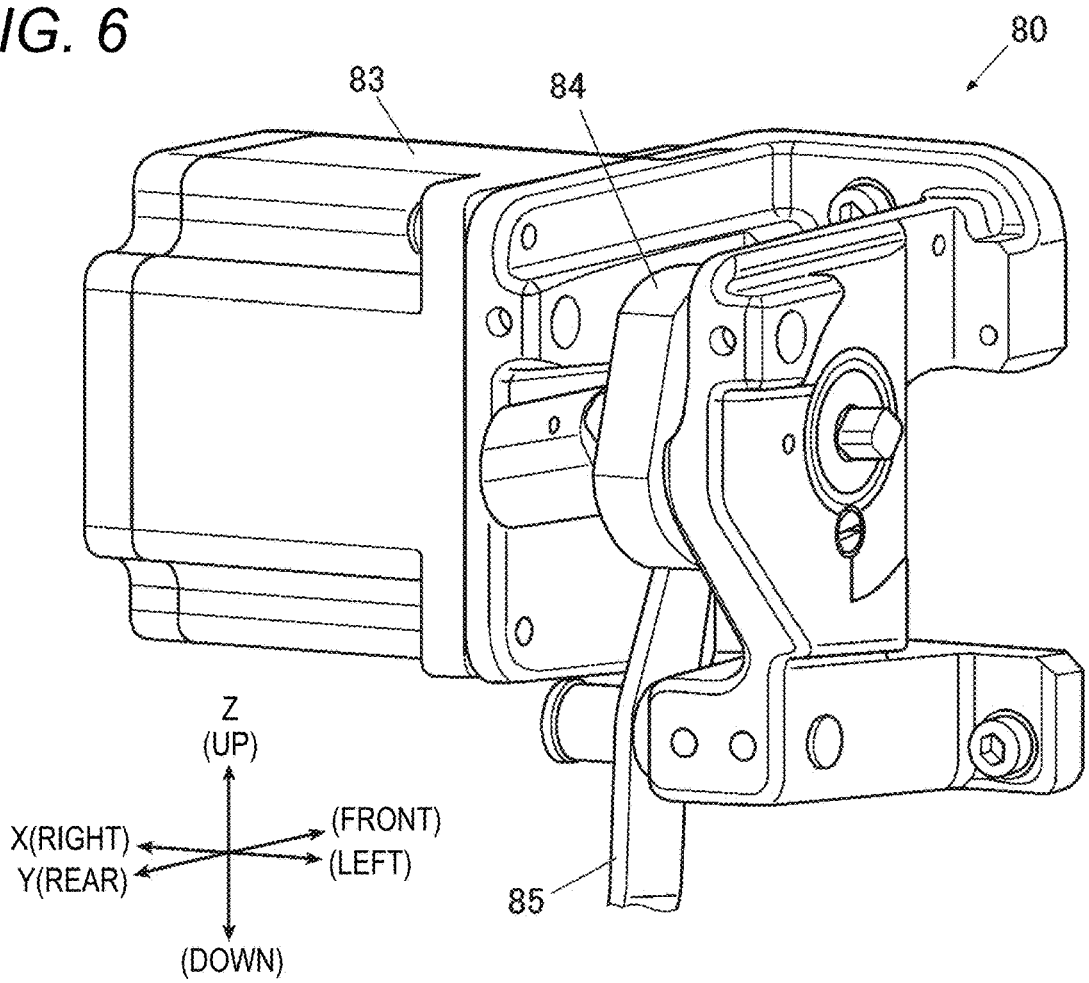
FIG. 6 is a perspective view of a part of the thread cutter.
Figure 7:
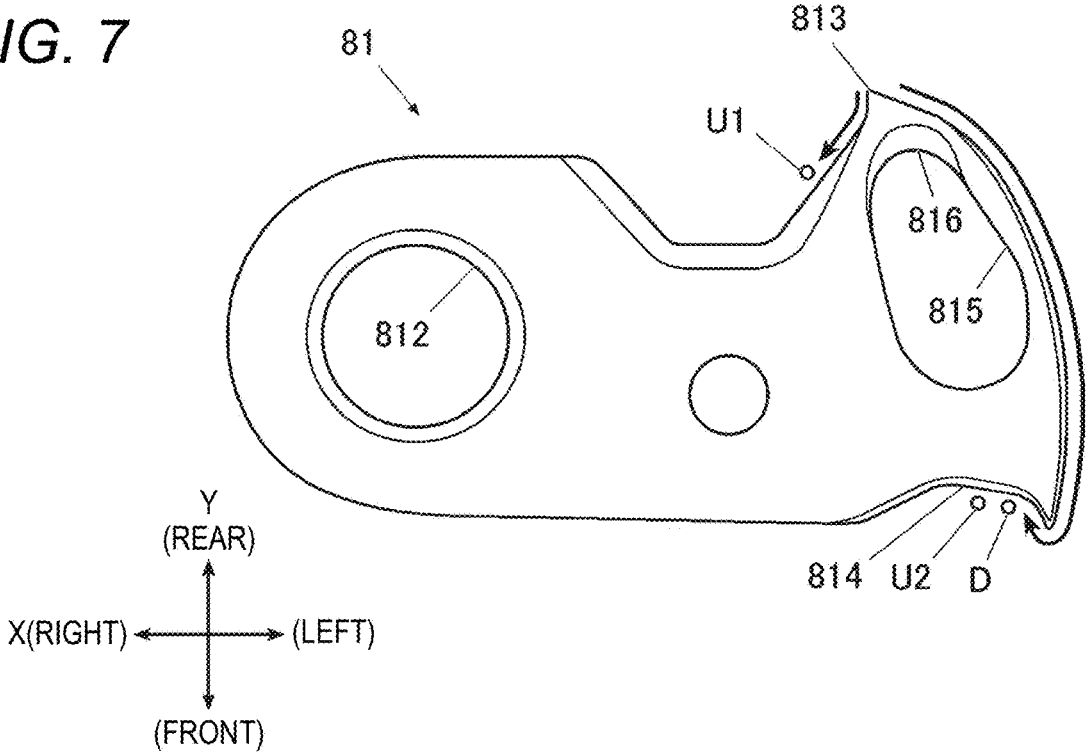
FIG. 7 is a bottom view of a moving knife.

FIG. 4 is a bottom view of the thread cutter 80 and the thread collector 40, FIG. 5 is a perspective view of the thread cutter 80, FIG. 6 is a perspective view of a part of the thread cutter 80, and FIG. 7 is a bottom view of a moving knife 81.

The thread cutter 80 includes the moving knife 81 that rotates around the Z-axis; a fixed knife 82 that cuts the upper thread U and the lower thread D in cooperation with the moving knife 81; a thread cutting motor 83 serving as an actuator that is a driving source of the rotation operation of the moving knife 81; a thread cutting cam 84 provided on the output shaft of the thread cutting motor 83; a thread cutting link 85 that swings by the thread cutting cam 84; a connecting rod 86 that transmits a forward and rearward reciprocating operation from the thread cutting link 85 to the moving knife 81 side; a rotary arm 87 connected to the connecting rod 86 to perform the rotation operation; and a connecting link 88 for connecting the rotary arm 87 and the moving knife 81 to each other.

The thread cutting motor 83 is attached to the rear portion of the frame 20 in a state where the output shaft is oriented in the X-axis direction (leftward direction) at a position higher than the throat plate 16.

On the output shaft of the thread cutting motor 83, the thread cutting cam 84 is provided to be fixed. The thread cutting cam 84 is an outer peripheral cam, and the upper-end portion of the thread cutting link 85 abuts against the outer periphery via a roller (not illustrated).

The thread cutting link 85 is a long link body along the Z-axis direction, and is supported to be rotatable around the X-axis at a position slightly above the middle portion in the longitudinal direction, in the frame 20. As described above, in the upper-end portion of the thread cutting link 85, the roller that abuts against the outer periphery of the thread cutting cam 84 is provided, and the lower-end portion is connected to the rear end portion of the connecting rod 86 to be rotatable around the X-axis.

Therefore, when the thread cutting motor 83 is driven, the thread cutting link 85 can cause the upper-end portion and the lower-end portion to swing in the front-rear direction via the thread cutting cam 84, and can apply the forward and rearward reciprocation to the connecting rod 86.

The connecting rod 86 is a rod-like body along the Y-axis direction, the rear end portion thereof is connected to the lower-end portion of the above-described thread cutting link 85, and the front end portion thereof is linked to the left end portion of the rotary arm 87 to be rotatable around the Z-axis.

The rotary arm 87 is a link body generally along the X-axis direction, and the middle portion in the longitudinal direction is supported to be rotatable around the Z-axis by a stage screw 871, on the lower surface side of the throat plate 16.

In addition, since the left end portion of the rotary arm 87 is connected to the connecting rod 86, the swinging operation in the front-rear direction is applied to both the left and right end portions.

The right end portion of the rotating arm 87 is connected to the front end portion of the connecting link 88 to be rotatable around the Z-axis.

The connecting link 88 is a link body along the Y-axis direction, and the rear end portion thereof is connected to the vicinity of the rotation end portion of the moving knife 81 to be rotatable around the Z-axis.

The moving knife 81 is supported to be rotatable around the Z-axis by a stage screw 811 on the lower surface side of the throat plate 16.

The rotation end portion of the moving knife 81 is generally oriented to the X-axis direction, and the reciprocating operation is applied in the front-rear direction from the connecting link 88 to rotate the rotation end portion forward and rearward.

As illustrated in FIG. 7, in the moving knife 81, a through-hole 812 into which the stage screw 811 is inserted is formed in the right end portion, and the left end portion thereof rotates forward and rearward.

In addition, a sorting portion 813 having a shape that is sharpened rearward is formed in the rear end portion in the rotation end portion of the moving knife 81, and a thread handling portion 814 that is recessed rearward is formed in the front end portion in the rotation end portion.

Further, a long hole 815 (through-hole) along the rotation circumferential direction is formed to penetrate the rotation end portion of the moving knife 81. In addition, a thread cutting portion 816 is formed on the rear end portion side in the inner edge portion of the long hole 815.

In the thread cutting portion 816, an edge is formed such that a sectional shape of the upper surface side (the side that is in sliding contact with the fixed knife 82) of the moving knife 81 has an acute angle.

The moving knife 81 is disposed on the lower surface of the throat plate 16 such that the tip end portion of the sorting portion 813 passes immediately below the needle hole 161 by rotation.

After the sewing needle 11 that has made the stitch point of the final stitch of the sewing passes above the needle hole 161, when the moving knife 81 rotates rearward and the sorting portion 813 passes immediately below the needle hole 161 from the front side toward the rear side of the needle hole 161, it is possible to sort a part U1 on the sewing needle 11 side and a part U2 on the cloth K side in a loop of the upper thread U drawn to the lower side from the needle hole 161.

When the moving knife 81 rotates up to a specified final retreat position, the part U1 on the sewing needle 11 side in the loop of the upper thread U moves inward in a rotation radial direction than the sorting portion 813, and the part U2 on the cloth K side in the loop of the upper thread U moves outward in the rotation radial direction than the sorting portion 813 together with the lower thread D and moves to the thread handling portion 814 along an outer edge portion of the rotation end portion of the moving knife 81.

At this time, the thread handling portion 814 of the moving knife 81 moves to the rear side of a thread cutting portion 821 of the fixed knife 82.

Meanwhile, the fixed knife 82 is provided between the moving knife 81 and the throat plate 16 in the Z-axis direction in a state where the thread cutting portion 821 serving as a cutting edge thereof is oriented rearward. When the moving knife 81 rotates forward from the specified final retreat position, the part U2 on the cloth K side in the loop of the upper thread U and the lower thread D are reeled up (guided) toward the thread cutting portion 821 side of the fixed knife 82. Since the distal end of the thread handling portion 814 is not sharpened, the part U2 on the cloth K side of the upper thread U and the lower thread D are not cut at the position where the tip end portion of the thread handling portion 814 and the thread cutting portion 821 closely pass each other, and enter between the lower surface of the fixed knife 82 and the upper surface of the moving knife 81. When the moving knife 81 further rotates rearward, the part U2 on the cloth K side of the upper thread U and the lower thread D are guided to the inside of the long hole 815, and when the thread cutting portion 821 of the fixed knife 82 and the thread cutting portion 816 of the long hole 815 closely pass each other, the part U2 on the cloth K side of the upper thread U and the lower thread D are inserted and cut.

The long hole 815 formed to penetrate between the sorting portion 813 and the thread handling portion 814 is open to be larger than the needle hole 161, the moving knife 81 is rotated at a position where the sorting portion 813 is behind the needle hole 161, and accordingly, the entire needle hole 161 can be overlapped so as to be accommodated inside the long hole 815 when viewed from the Z-axis direction.

Since the thread cutting portion 816 is formed in the rear end portion of the inner edge portion of the long hole 815, in a state where the needle hole 161 is overlapped inside the above-described long hole 815, the stitch point is made. When the sewing needle 11 is raised above the needle hole 161, even in a case of rotating the moving knife 81 forward, it is possible to cut the upper thread U.

[Thread Collector]

Figure 8:
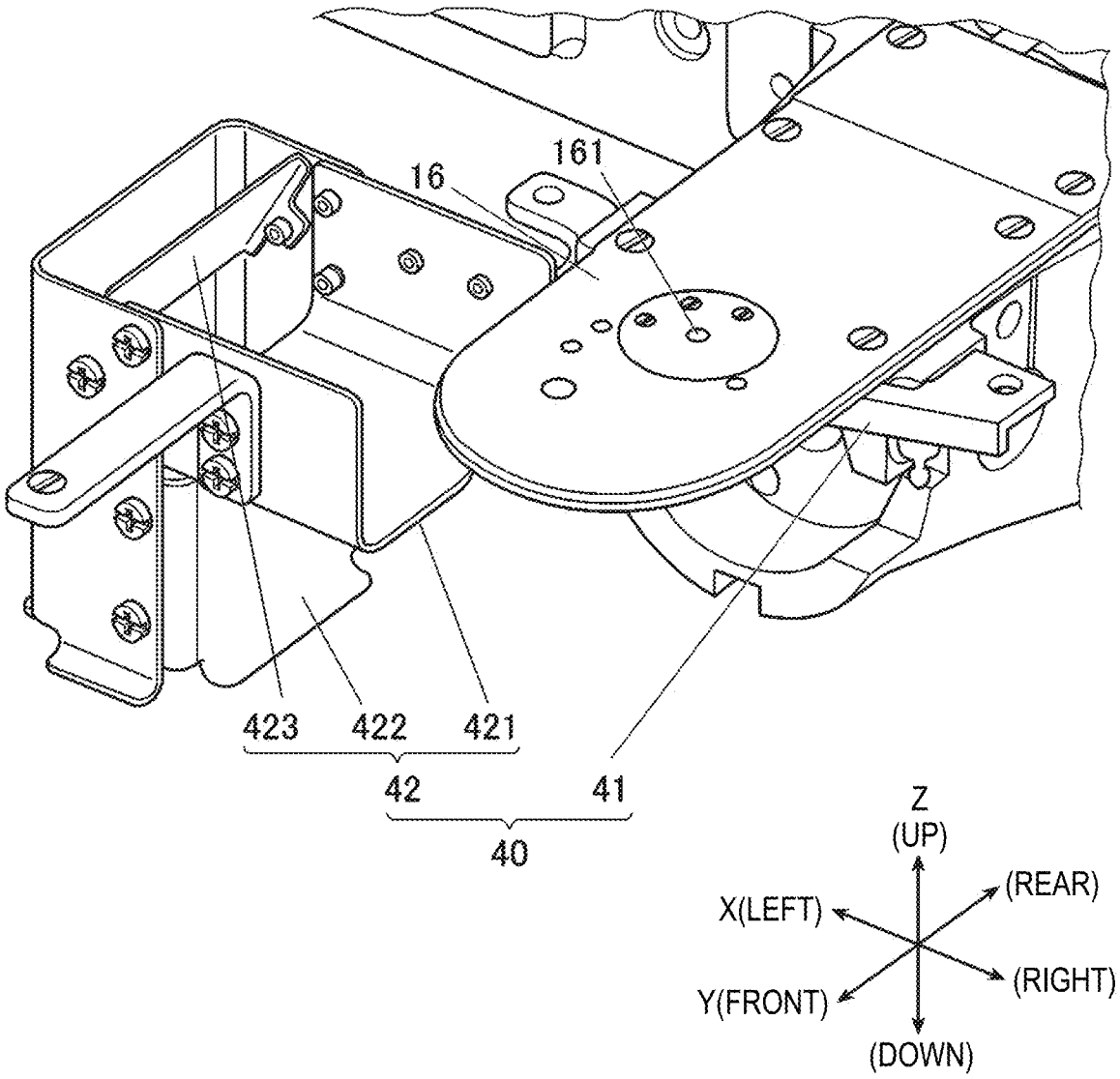
FIG. 8 is a perspective view of the thread collector.

FIG. 8 is a perspective view of the thread collector 40.

As illustrated in FIGS. 4 and 7, the thread collector 40 includes an air blow mechanism 41 that blows air to the sewing start end portion U3 of the upper thread U cut by the thread cutter 80; and a capturing portion 42 that captures the sewing start end portion U3 of the upper thread U blown away by the air.

The air blow mechanism 41 includes a nozzle 411 that is disposed on the lower side of the throat plate 16 and slightly rear on the right side of the needle hole 161 when viewed from below, and discharges the air in a direction of passing through the needle hole 161 or the immediate vicinity thereof slightly forward on the left side; and an air feed source (not illustrated) that feeds high-pressure air to the nozzle 411.

The capturing portion 42 includes a dust collection guide 421 which is disposed on the side opposite to the nozzle 411 across the needle hole 161 and has a U-shaped section, when viewed from below; and a rectangular cylindrical dust collection dust 422 connected to the end portion on the downstream side in an air blowing direction of the dust collection guide 421.

The dust collection guide 421 has a bottom plate along the X-Y plane, and both side wall portions that stand along the X-Z plane in both end portions of the bottom plate in the Y-axis direction, and can guide the sewing start end portion U3 of the upper thread U leftward on the inside thereof.

The right end portion of the dust collection guide 421 extends to the vicinity of the left end portion of the throat plate 16, and the left end portion of the dust collection guide 421 is connected to the upper-end portion of the dust collection dust 422.

The dust collection dust 422 is a rectangular cylindrical body opened upward and downward, and the right side of the upper-end portion is cut away and connected to the dust collection guide 421.

At the position inside the upper-end of the dust collection dust 422 and facing the left end portion of the dust collection guide 421, a sweep plate 423 inclined toward the left-diagonally lower side is provided. The sweep plate 423 can adjust an inclination angle, can sweep down the sewing start end portion U3 of the upper thread U that has been moved leftward in the dust collection guide 421 downward in the dust collection dust 422, and can excellently collect the sewing start end portion U3.

The lower-end portion of the dust collection dust 422 is open, and a collection box or a collection bag of the sewing start end portion U3 of the removable upper thread U is mounted in the lower-end portion thereof.

[Control System of Sewing Machine]

As illustrated in FIG. 3, the controller 120 schematically includes a ROM 122 in which various control programs are stored and accommodated; a CPU 121 that performs various arithmetic processing in accordance with the various programs; a RAM 123 used as a work memory in various processing; and an EEPROM 124 in which various sewing data and setting data are accommodated.

The motor 31 and the encoder 37 of the needle vertical movement mechanism 30; the X-axis motor 65, an encoder 651, the Y-axis motor 66, an encoder 661, and the raising and lowering motor 64 of the feed mechanism 60; the thread cutting motor 83 and an encoder 831 of the thread cutter 80; and an air feed solenoid valve 412 that feeds the high-pressure air to the nozzle 411 of the air blow mechanism 41 of the thread collector 40 are connected to the controller 120 via a system bus, an interface, a driving circuit or the like (which are not illustrated).

The encoder 37 detects a shaft angle of the output shaft of the motor 31, the encoder 651 detects a shaft angle of the output shaft of the X-axis motor 65, the encoder 661 detects a shaft angle of the output shaft of the Y-axis motor 66, and the encoder 831 detects a shaft angle of the output shaft of the thread cutting motor 83.

Further, an operation input portion 125 that inputs various settings related to the sewing and a pedal 126 serving as signal input means, such as the execution of the sewing, are connected to the controller 120.

In the operation input portion 125, for example, the number of stitches in sewing pattern data and various commands, such as elimination of stitch point positions, are set.

The pedal 126 is depressed to input an instruction to start the sewing.

[Basic Sewing Operation Control in Sewing]

The controller 120 executes reading of the stitch point position from the sewing pattern data at the specified upper shaft angle for each stitch based on the output of the encoder 37 together with the start of driving of the motor 31 as the basic sewing operation control, controls the X-axis motor 65 and the Y-axis motor 66, and positions the lower plate 61 and the presser foot 63 such that the stitch point is made at the stitch point position read from the sewing pattern data. When the stitch points are sequentially made for all the numbers of stitches determined by the sewing pattern data, the thread cutting motor 83 of the thread cutter 80 is controlled to perform the forward and rearward reciprocating rotation such that the entire moving knife 81 passes below the needle hole 161, and performs the cutting operation of the upper thread U and the lower thread D by the thread cutting portion 816 to stop the motor 31 and ends the sewing.

[Sewing Start Control in Sewing]

In parallel with the basic sewing operation control, the controller 120 executes the sewing start control by the thread cutter 80 and the thread collector 40 for a few stitches from the sewing start time.

Figure 9:
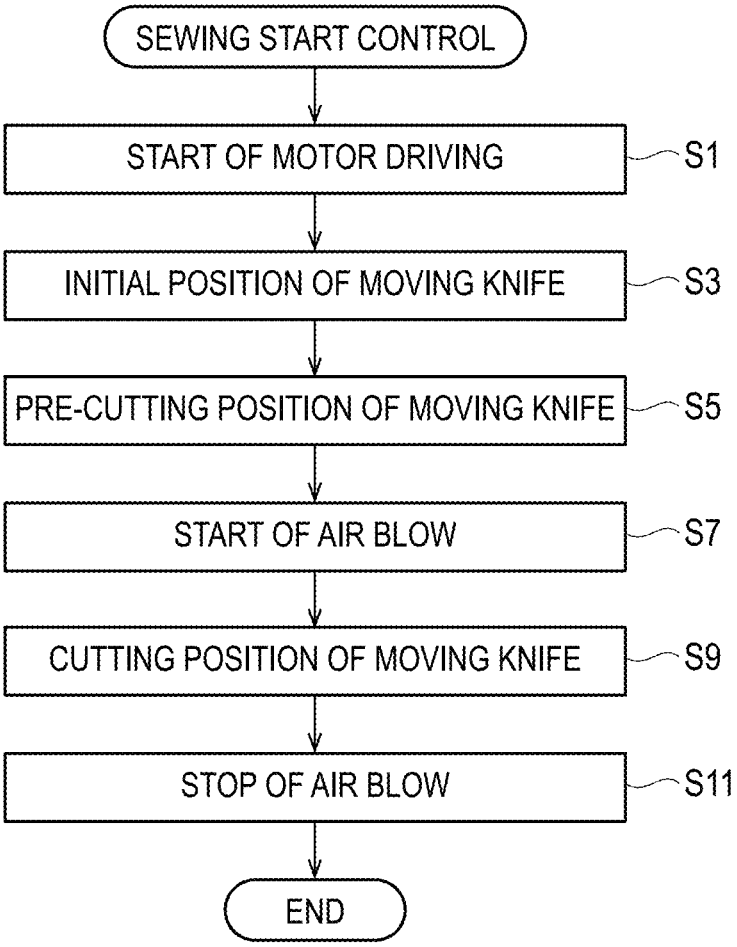
FIG. 9 is a flowchart of sewing start control.
Figure 10:
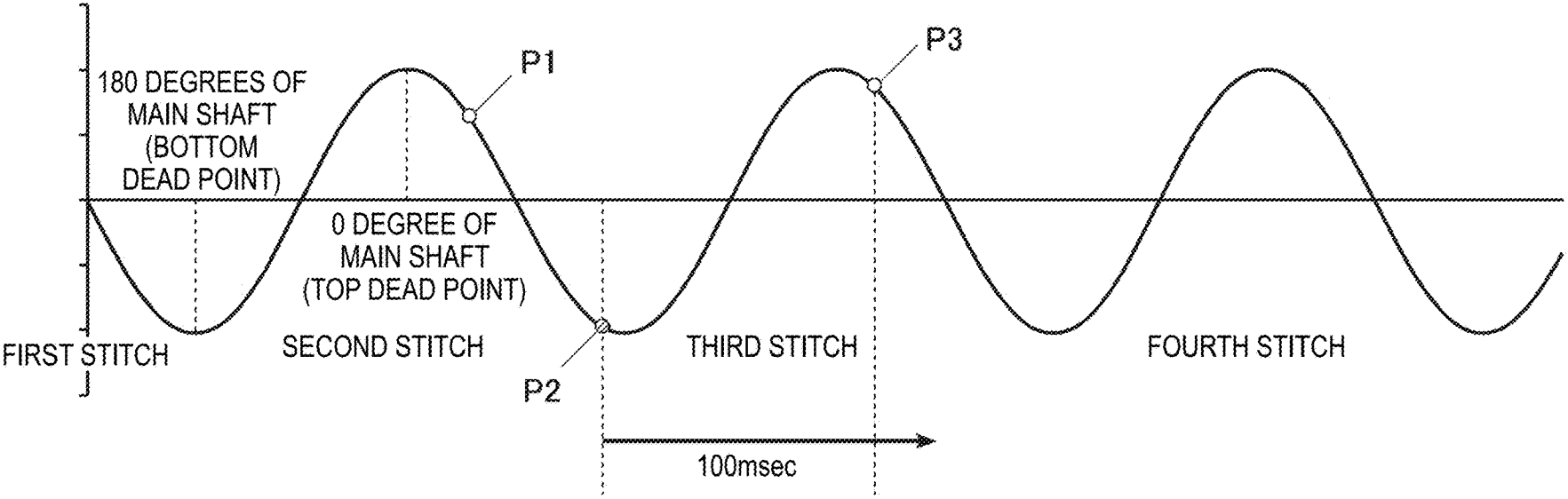
FIG. 10 is a diagram illustrating a change in height of a sewing needle during the sewing start control and execution timings of various operations in the sewing start control.
Figure 13:
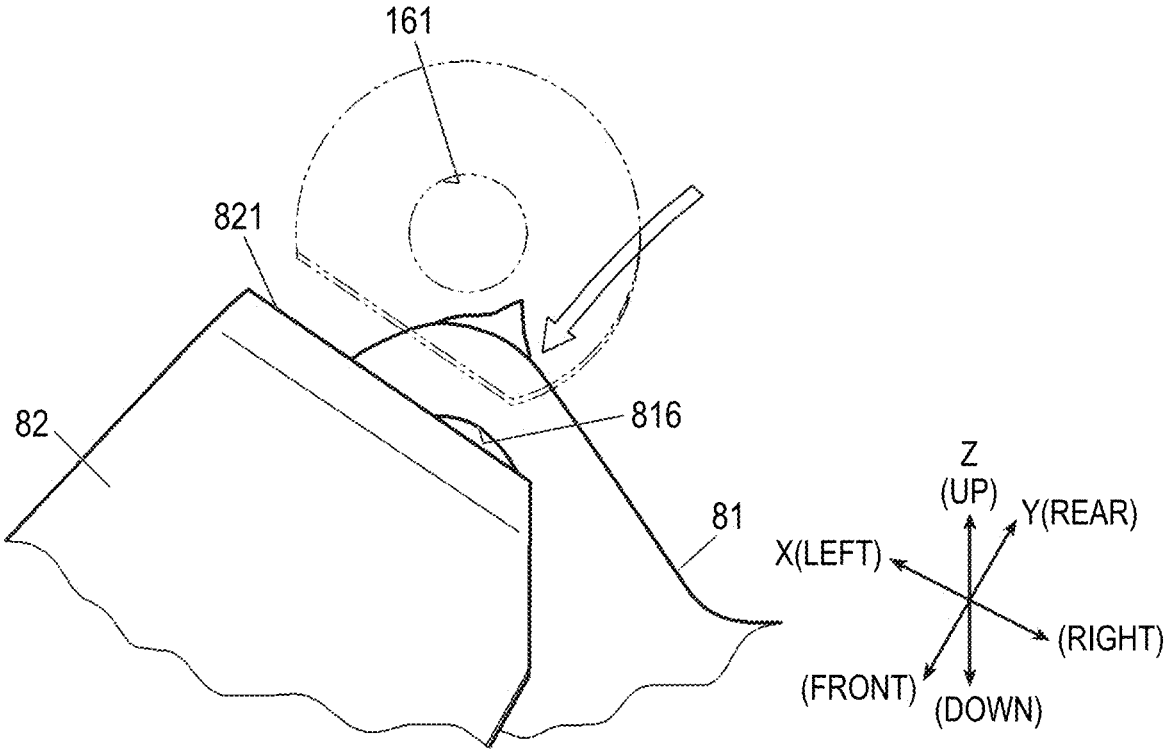
FIG. 13 is a perspective view around the needle hole that corresponds to FIG. 11B.
Figure 14:
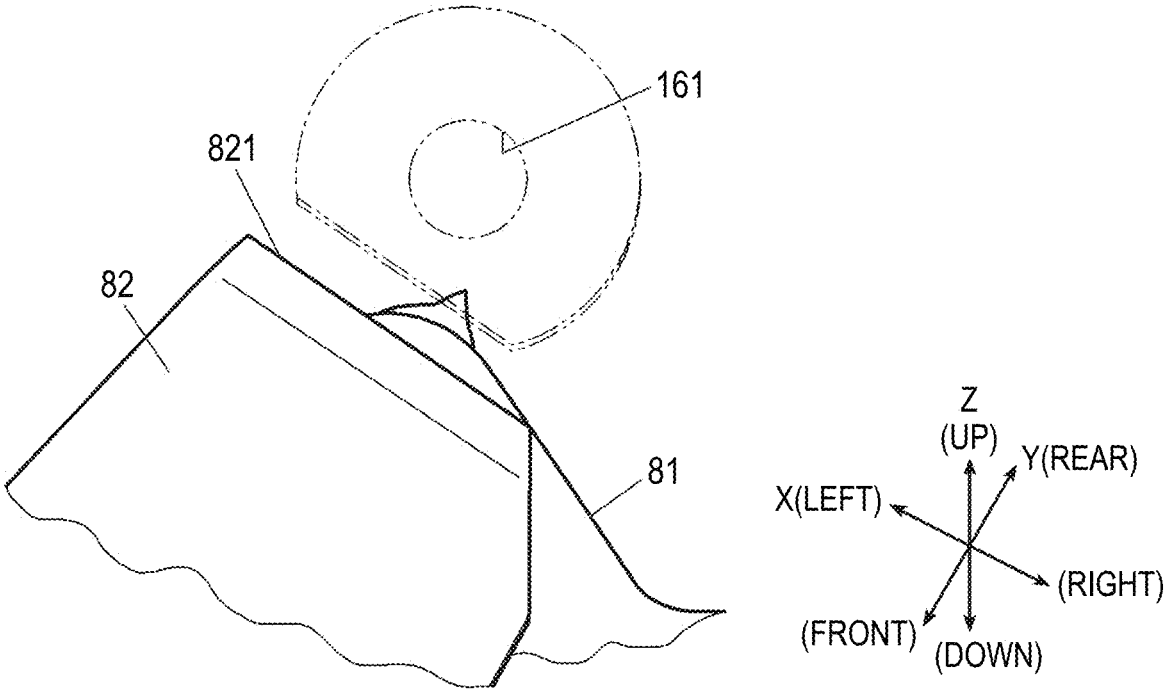
FIG. 14 is a perspective view around the needle hole that corresponds to FIG. 11D.

Hereinafter, the sewing start control will be described based on FIGS. 9 to 14. FIG. 9 is a flowchart of the sewing start control, FIG. 10 is a timing diagram of the sewing start control, FIGS. 11A to 11D are operation explanatory views in the sewing start control, and FIGS. 12 to 14 are perspective views around the needle hole during the sewing start control.

In the sewing start control, the controller 120 starts the driving of the motor 31 for sewing (step S1) and controls the thread cutting motor 83 to position the moving knife 81 at the initial position (step S3).

The "initial position" of the moving knife 81 is a position that overlaps such that the entire needle hole 161 fits inside the long hole 815 of the moving knife 81 when viewed from the Z-axis direction. At the "initial position", any rotation angle may be employed as long as the rotation angle of the moving knife 81 is within the range in which the entire needle hole 161 fits inside the long hole 815 of the moving knife 81, but it is desirable that the thread cutting portion 816 is closer to thread cutting portion 821 of the fixed knife 82. The shaft angle of the thread cutting motor 83 that satisfies the condition is registered in the EEPROM 124 in advance, and the thread cutting motor 83 is controlled such that the output of the encoder 831 stops at the position where the shaft angle is detected.

Figure 12:
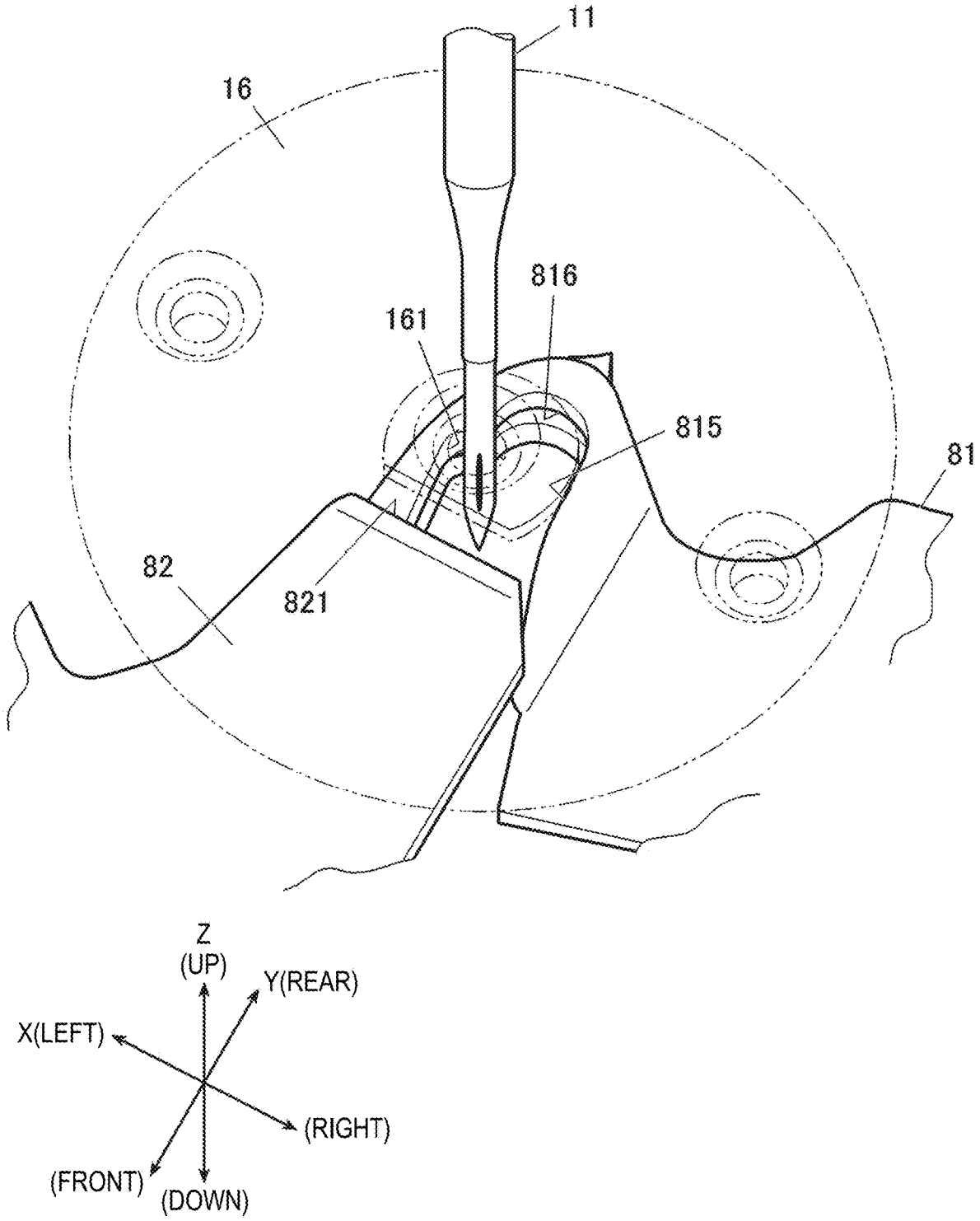
FIG. 12 is a perspective view around a needle hole that corresponds to FIG. 11A.

In addition, in a state where the moving knife 81 is positioned at the initial position, the stitch point of the first stitch from the sewing start is made, and as illustrated in FIG. 12, the sewing needle 11 plunges into the long hole 815 of the moving knife 81 through the needle hole 161.

Figure 11A:
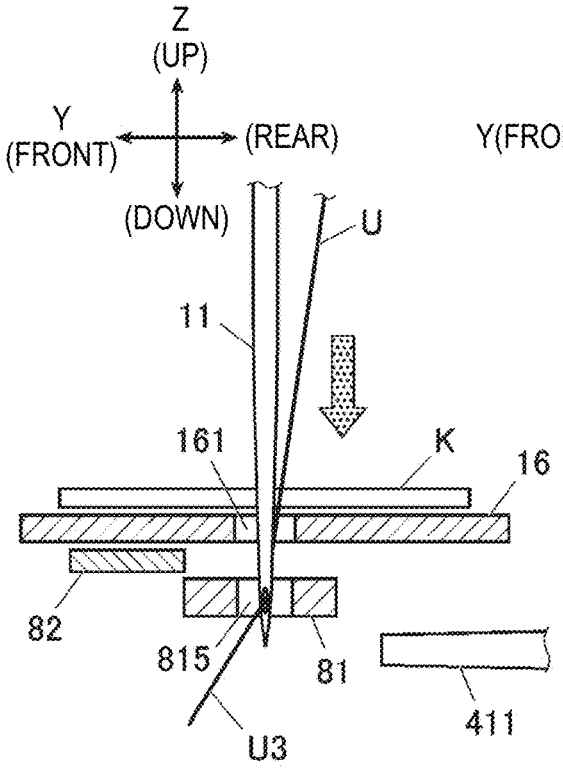
FIGS. 11A to 11D are operation explanatory views sequentially illustrating the operation of the thread cutter and the thread collector in the sewing start control.

At this time, as illustrated in FIG. 11A, the sewing start end portion U3 of the upper thread U that has passed through the sewing needle 11 is captured by a hook of the outer shuttle of the shuttle mechanism 50, and is in a state of being drawn to the lower side via the long hole 815 of the moving knife 81.

Next, when the sewing needle 11 is raised to a top dead point (upper shaft angle 0°), the controller 120 counts the second stitch of the sewing needle. At this time, a state where the sewing start end portion U3 of the upper thread U is inserted into the long hole 815 of the moving knife 81 is maintained.

When the sewing needle 11 starts the lowering operation of the second stitch and the encoder 37 detects a predetermined upper shaft angle P1 (refer to FIG. 10), the controller 120 controls the thread cutting motor 83 and positions the moving knife 81 at a pre-cutting position (step S5).

Figure 11B:
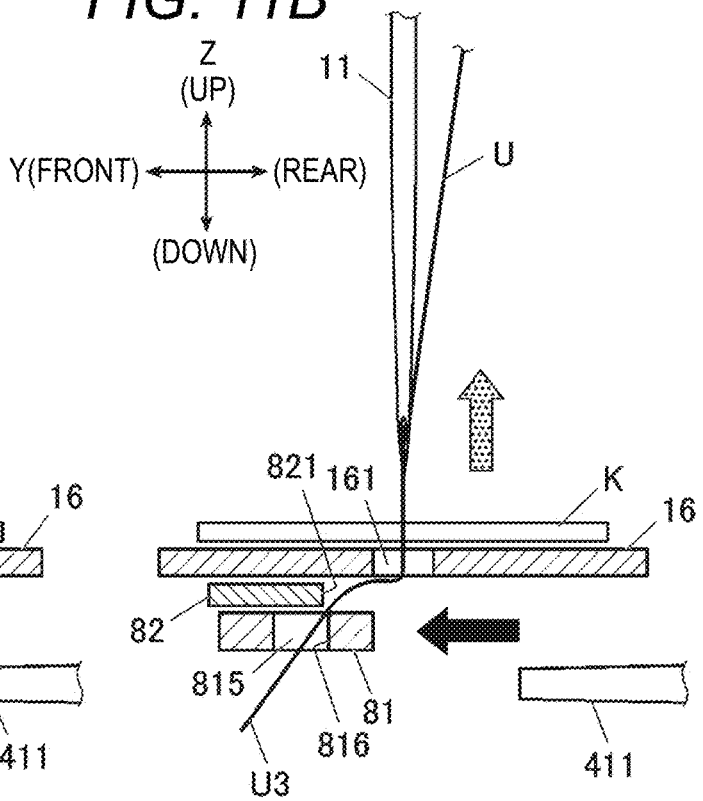

The "pre-cutting position" of the moving knife 81 is a position where the moving knife 81 moves forward from the initial position as illustrated in FIGS. 11B and 13 and the moving knife 81 does not overlap the needle hole 161 at all when viewed from the Z-axis direction, and is a position where a gap to the extent that the upper thread U is not cut and can be lightly pinched is generated between the second thread cutting portion 816 of the moving knife 81 and the thread cutting portion 821 of the fixed knife 82 when viewed from the Z-axis direction.

The shaft angle of the thread cutting motor 83 that satisfies the condition is registered in the EEPROM 124 in advance, and the thread cutting motor 83 is controlled such that the output of the encoder 831 stops at the position where the shaft angle is detected.

Accordingly, the sewing start end portion U3 of the upper thread U can be maintained in a state of being inserted into the long hole 815 of the moving knife 81.

The above-described "predetermined upper shaft angle P1" may be from the top dead point which is the start of the second stitch of the sewing needle 11 until reaching the cloth K, but here, the upper shaft angle (52° when the top dead point is 0° and the bottom dead point is 180°) at which a thread take-up lever top dead point is achieved is exemplified.

In a state where the moving knife 81 is positioned at the pre-cutting position, the stitch point of the second stitch from the sewing start is made, and the sewing needle 11 plunges into the needle hole 161.

Figure 11C:
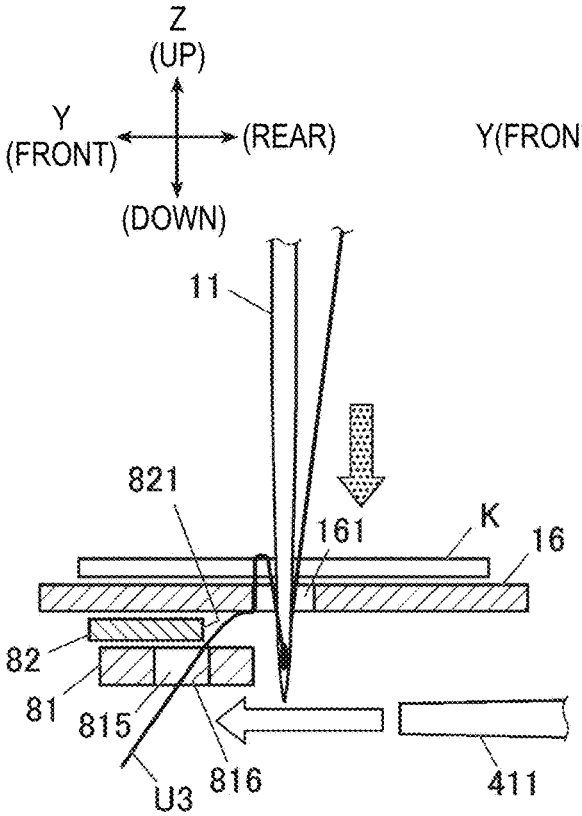

Furthermore, when a predetermined upper shaft angle P2 (refer to FIG. 10) is detected by the encoder 37, the controller 120 controls the air feed solenoid valve 412 of the thread collector 40 to discharge the high-pressure air from the nozzle 411 (step S7, FIG. 11C).

The above-described predetermined upper shaft angle P2 may be after the arrival of the second stitch of the sewing needle 11 at the cloth K, and before cutting the sewing start end portion U3 of the upper thread U, but here, the upper shaft angle (for example, 152°) which is close to the bottom dead point of the sewing needle 11 is exemplified.

Further, together with the discharge of the high-pressure air, the controller 120 starts counting a discharge continuation time of the high-pressure air. The discharge continuation time is a time that continues until at least the cutting of the sewing start end portion U3 of the upper thread U is completed. For example, the discharge continuation time is approximately one cycle of the vertical movement of the sewing needle 11. Here, 100 msec is exemplified.

Next, when the sewing needle 11 is raised to the top dead point (upper shaft angle 0°), the controller 120 counts the third stitch of the sewing needle 11. At this point, the seam of the second stitch is formed by the upper thread U and the lower thread D, but since the sewing start end portion U3 of the upper thread U is held at a position (position of the thread cutting portion 821 of the fixed knife 82) separated from the needle hole 161, the sewing start end portion U3 of the upper thread U is avoided from being caught in the seam.

Further, since the sewing start end portion U3 is blown to the side opposite to the needle hole 161 by the air, the sewing start end portion U3 can be prevented from being caught in the seam from this point of view.

Wen the sewing needle 11 starts the lowering operation of the third stitch and the encoder 37 detects a predetermined upper shaft angle P3 (refer to FIG. 10), the controller 120 controls the thread cutting motor 83, positions the moving knife 81 at a cutting position, and cuts the sewing start end portion U3 of the upper thread U (step S9).

Figure 11D:
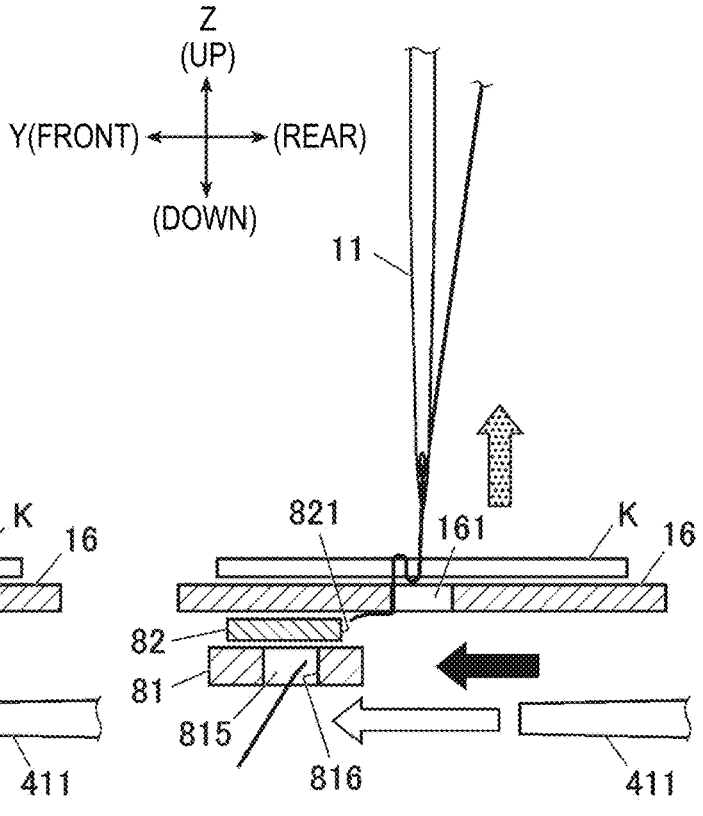

As illustrated in FIGS. 11D and 14, the "cutting position" of the moving knife 81 is a position where the moving knife 81 moves forward from the pre-cutting position and the thread cutting portion 816 of the moving knife 81 passes the thread cutting portion 821 of the fixed knife 82 to be on the forward side than the thread cutting portion 821.

The shaft angle of the thread cutting motor 83 that satisfies the condition is registered in the EEPROM 124 in advance, and the thread cutting motor 83 is controlled such that the output of the encoder 831 stops at the position where the shaft angle is detected.

Accordingly, the sewing start end portion U3 of the upper thread U is cut. The sewing start end portion U3 of the cut upper thread U is blown to the dust collection guide 421 side of the capturing portion 42 by the high-pressure air from the nozzle 411 of the thread collector 40 and is collected through the dust collection dust 422.

The above-described predetermined "upper shaft angle P3" may be after the top dead point that is the start of the third stitch of the sewing needle 11, but is desirably an upper shaft angle that is after the thread take-up lever top dead point and before the start of the movement of the cloth K by the feed mechanism 60. Here, 64°, which is the timing at which the seam of the second stitch is knotted, is exemplified.

The controller 120 counts up the discharge continuation time of the high-pressure air, controls the air feed solenoid valve 412 of the thread collector 40, and stops the feed of the high-pressure air to the nozzle 411 (step S11).

The controller 120 ends the sewing start control.

Technical Effects of Embodiment of Invention

In the sewing machine 10, the moving knife 81 has a long hole 815 into which the sewing needle 11 is loosely insertable and includes the thread cutting portion 816 in the inner edge portion of the through-hole 815, and the controller 120 controls the thread cutting motor 83 and makes the stitch point of the first stitch of the sewing needle 11 with respect to the long hole 815 of the moving knife 81.

Therefore, the sewing start end portion U3 in the long hole 815 can be excellently held, and the occurrence of bird's nest due to the sewing-in of the sewing start end portion U3 can be more effectively reduced.

By making the stitch point in the long hole 815, at the next stitch point, the moving knife 81 can be moved to a pinch position with the fixed knife 82 at a small rotation angle, and at the next stitch point, the moving knife 81 can be easily prevented from interfering with the sewing needle 11.

Since the moving knife 81 is rotatable, when the moving knife 81 is rotated in a state where the sewing start end portion U3 of the upper thread U is loosely inserted into the long hole 815 of the moving knife 81, at the time of forming the seam of the second stitch, the sewing start end portion U3 of the upper thread U is easily separated from the needle hole 161, and the occurrence of bird's nest due to the sewing-in of the sewing start end portion U3 can be more effectively reduced.

Since the sewing start end portion U3 is cut, the length of the end portion of the upper thread U that remains in the cloth K can be shortened, and accordingly, the sewing quality can be improved.

Furthermore, since the thread cutter 80 cuts the sewing start end portion U3 of the upper thread U, it is possible to make a dedicated device for cutting the sewing start end portion U3 unnecessary.

In particular, since a number of devices, such as the shuttle mechanism 50, the thread cutter 80, and the like, are disposed under the throat plate 16, it is difficult to secure space for installing new devices, and thus, the fact that a dedicated device is unnecessary is particularly effective.

The sewing machine 10 performs the sewing start control by controlling the thread cutting motor 83 to move the moving knife 81 to the pre-cutting position where the sewing start end portion U3 of the upper thread U is pinched without being cut by the fixed knife 82 and the moving knife 81 after the stitch point (for example, 52° of the upper shaft angle of the second stitch) of the first stitch of the sewing needle 11, and to move the moving knife 81 to the cutting position where the sewing start end portion U3 of the upper thread U is cut by the fixed knife 82 and the moving knife 81 after the stitch point (for example, 64° of the upper shaft angle of the third stitch) of the second stitch of the sewing needle 11.

Accordingly, when forming the seam of the second stitch, the sewing start end portion U3 of the upper thread U can be excellently held in the needle hole 161, and the occurrence of bird's nest due to the sewing-in of the sewing start end portion U3 can be more effectively reduced.

Furthermore, since the thread cutter 80 holds the sewing start end portion U3 of the upper thread U, it is possible to make a dedicated device for holding the sewing start end portion U3 unnecessary.

Since the sewing machine 10 includes the thread collector 40 for collecting the sewing start end portion U3 of the upper thread U cut by the thread cutter 80, the sewing start end portion U3 after cutting can be collected at a fixed place, and cleaning work or maintenance work can be easily performed.

The thread collector 40 also includes the air blow mechanism 41 that blows the air to the sewing start end portion U3 of the upper thread U.

By blowing the air of the air blow mechanism 41, since it is possible to make the sewing start end portion U3 inclined in a certain direction, the occurrence of bird's nest due to the sewing-in of the sewing start end portion U3 can be more effectively reduced.

Since the thread collector 40 includes the air blow mechanism 41 that blows the air to the sewing start end portion U3 of the upper thread U and the capturing portion 42 that captures the sewing start end portion U3, it is possible to actively guide and collect the sewing start end portion U3, and it becomes possible to reduce collection missing and more effectively to collect the sewing start end portion U3.

The controller 120 performs control by controlling the air blow mechanism 41 to start the air blowing before starting the cutting operation of the sewing start end portion U3 of the upper thread U by the moving knife 81, which is performed after the stitch point of the second stitch of the sewing needle, and to end the air blowing after completing the cutting operation of the sewing start end portion U3 of the upper thread U by the moving knife 81.

By blowing the air, since it is possible to make the sewing start end portion U3 inclined in a certain direction, the occurrence of bird's nest due to the sewing-in of the sewing start end portion U3 can be more effectively reduced at more appropriate timing.

Further, it is possible to more reliably guide and collect the sewing start end portion U3, and it becomes possible to further reduce the collection missing and more effectively collect the sewing start end portion U3.

[Others]

Although the electronic cycle sewing machine is exemplified in the embodiment, the present invention is not limited thereto. The control of cutting the sewing start end portion of the upper thread U can be applied to other types of sewing machines provided with a thread cutter. For example, as an example, the control can also be applied to a lockstitch sewing machine that feeds the cloth K at a constant pitch in a fixed direction by a feed dog.

Although a shuttle mechanism having a half rotary shuttle is exemplified as the shuttle mechanism 50, the type of the shuttle may be any other type.

Although a device in which the moving knife 81 rotates around the vertical shaft is exemplified as the thread cutter 80, the present invention is not limited thereto. It is possible to apply the control for pinching the sewing start end portion of the upper thread U as long as the device is a thread cutter having a structure in which the fixed knife and the moving knife are provided and capable of controlling the operation amount to pinch the sewing start end portion U3. Therefore, for example, the control can also be applied to a thread cutter having a linear motion type moving knife or a moving knife that rotates around a horizontal shaft.

Further, the controller 120 performs control for ending the blowing of the air according to the elapse of a predetermined time from the start of the air blowing, but the control for ending the air blowing when a predetermined upper shaft angle is detected may be performed.

What is claimed is:

1. A sewing machine comprising:

a needle vertical movement mechanism that applies vertical movement to a sewing needle; and a thread cutter that cuts an upper thread passed through the sewing needle, on a lower side of a throat plate, wherein the thread cutter includes:

a fixed knife;

a moving knife that cuts the upper thread by guiding the upper thread close to a thread cutting portion of the fixed knife; and a driving source that drives the moving knife to guide the upper thread, the moving knife has a through-hole into which the sewing needle is loosely insertable and includes a thread cutting portion in an inner edge portion of the through-hole, and the sewing machine further includes:

a controller that, by controlling the driving source, makes a stitch point of a first stitch of the sewing needle with respect to the through-hole of the moving knife, and moves the moving knife to a position where the fixed knife and the moving knife cut a sewing start end portion of the upper thread after a stitch point of a second stitch of the sewing needle.

2. The sewing machine according to claim 1, wherein by the driving source, the controller maintains a state where the sewing start end portion of the upper thread is pinched by moving the moving knife to a pinch position without cutting the sewing start end portion of the upper thread by the fixed knife and the moving knife after the stitch point of the first stitch of the sewing needle.

3. The sewing machine according to claim 1, wherein the moving knife includes:

a sorting portion that is provided in an end portion on a downstream side in a direction which is opposite to a thread cutting operation with respect to the fixed knife and that sorts the upper thread; and a thread handling portion that is provided in an end portion on a downstream side in a direction of the thread cutting operation with respect to the fixed knife and that handles the upper thread, wherein the through-hole is provided between the sorting portion and the thread handling portion.

4. The sewing machine according to claim 1, further comprising:

an air blow mechanism that blows air to the sewing start end portion of the upper thread.

5. The sewing machine according to claim 4, further comprising:

a capturing portion that captures the sewing start end portion of the upper thread blown away by air blowing of the air blow mechanism.

6. The sewing machine according to claim 4, wherein by controlling the air blow mechanism, the controller starts the air blowing before starting a cutting operation of the sewing start end portion of the upper thread by the moving knife, which is performed after the stitch point of the second stitch of the sewing needle, and the controller ends the air blowing after completing the cutting operation of the sewing start end portion of the upper thread by the moving knife.

* * * * *